United States Patent [19]

Meyer et al.

[11] 4,200,197

[45] Apr. 29, 1980

[54] ANIMATED TOY BOX

[75] Inventors: Burton C. Meyer; Denise Gardner, both of Downers Grove, Ill.

[73] Assignee: Marvin Glass & Associates, Chicago, Ill.

[21] Appl. No.: 18

[22] Filed: Jan. 2, 1979

[51] Int. Cl.[2] ..... B65D 43/20; A63H 4/00; A63H 13/00

[52] U.S. Cl. ..... 220/263; D9/199; D7/195; 46/123; 46/116

[58] Field of Search ..... 220/263; D7/195; D9/199; 229/8; 46/116, 123

[56] References Cited

U.S. PATENT DOCUMENTS

| | | | |
|---|---|---|---|
| D. 245,228 | 8/1977 | Gilson et al. | D9/199 X |
| 1,176,046 | 3/1916 | Foldeak | 220/263 |
| 2,549,572 | 4/1951 | Campanelli | 20/263 X |
| 2,563,456 | 8/1951 | Brownell | 220/263 |
| 3,848,356 | 11/1974 | Wylie et al. | 220/8 X |

*Primary Examiner*—Steven M. Pollard

*Attorney, Agent, or Firm*—Mason, Kolehmainen, Rathburn & Wyss

[57] ABSTRACT

A toy storage apparatus having a decorative outer surface designed to appear as an animate object. The apparatus is adapted for operation by a child and includes a hollow body of substantial volume for holding toys, and a top or cover pivotally mounted on the body resembling the head of an animal. A foot pedal which is designed to appear as the foot of an animal is connected through linkage to open the cover exposing the upper end of the hollow body to receive toys.

3 Claims, 4 Drawing Figures

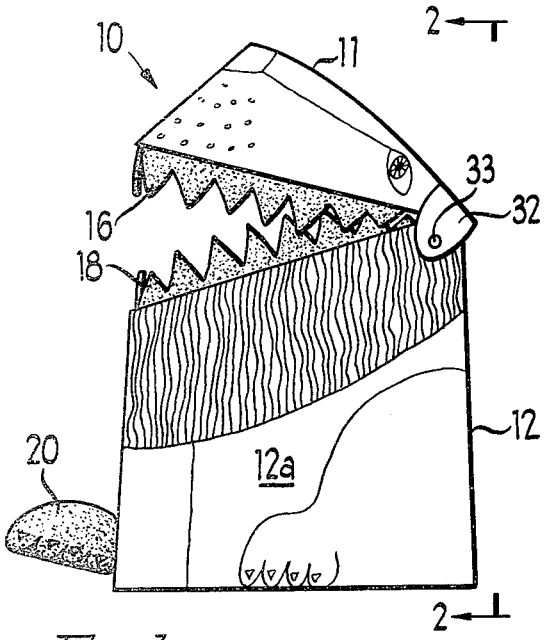
Fig 1
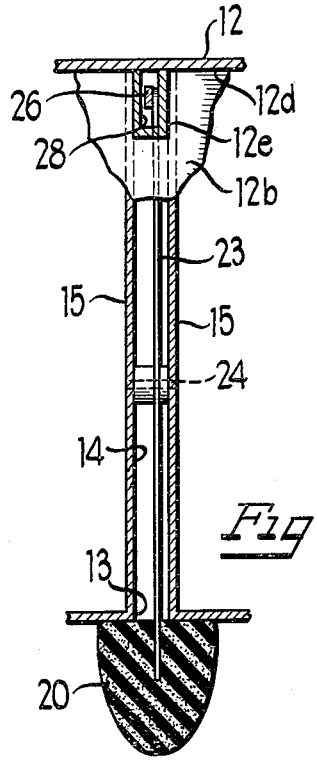
Fig 4
Fig 2
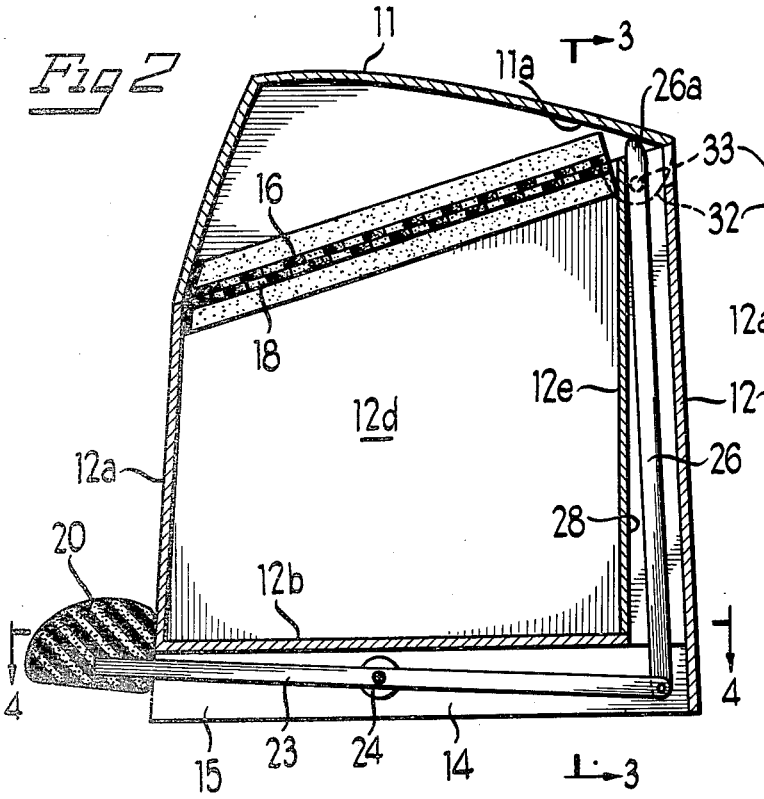
Fig 3
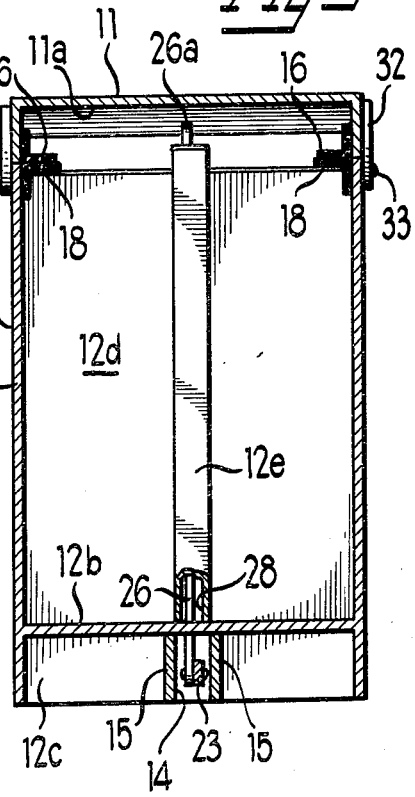

ANIMATED TOY BOX

BACKGROUND OF THE INVENTION

1. Field of the Invention

This invention relates to a toy storage device having a novel design with an educational purpose. The device is designed to store and hold children's toys and the like and is decorated to appear as an animal with a movable cover resembling an animal's head, a hollow lower portion resembling the animal's body, and a foot pedal resembling the animal's foot.

2. Description of the Prior Art

There are presently available various types of storage devices for children's toys. It is desirable to provide a device of the character described that is uniquely decorated to help a young child learn to distinguish different parts of an animal such as the head and body and which will encourage the child to put away his toys by using the device for this purpose.

OBJECTS OF THE INVENTION

It is an object of the present invention to provide a new and improved toy storage device for children's toys which is shaped and decorated to appear as an animate object. The appearance of the device encourages usage so that a child will learn to put away his toys. In addition, the appearance of the storage device will encourage the child to learn about the different parts of an animal's body.

SUMMARY OF THE INVENTION

A preferred embodiment of the invention includes a toy storage device having a large, hollow body open at the upper end and a cover pivotally mounted on the hollow body to open and close. The body is decorated to resemble the body of an animal and the cover appears as the animal's head. Rows of flexible teeth are provided and a foot pedal connected through linkage is adapted to open the top cover or head above the body which is provided with recess means to enclose the linkage.

BRIEF DESCRIPTION OF THE DRAWINGS

FIG. 1 is a side elevational view of a storage device in accordance with the features of the present invention;

FIG. 2 is a cross-sectional view taken generally along line 2—2 of FIG. 1;

FIG. 3 is a cross-sectional view of the storage device taken generally along line 3—3 of FIG. 2; and FIG. 4 is a fragmentary, cross-sectional view taken generally along the line 4—4 of FIG. 2.

DESCRIPTION OF THE PREFERRED EMBODIMENT

Referring to the drawings, and in particular to FIG. 1, there is illustrated a toy storage device generally designated 10, and constructed in accordance with the features of the present invention. The toy storage device includes a large, hollow body 12 with a cover 11 pivotally mounted adjacent the open upper end of the hollow body. The cover is shaped and decorated to resemble the head of an animal and the body 12 resembles the body thereof. A lower edge of the head 11 is provided with a row of upper teeth 16 formed of flexible strip material and the open upper end of the body 12 is similarly provided with a row of lower teeth 18. The upper and lower teeth are shaped like animal's teeth and fold readily inwardly when the cover is pivoted to open and close, resembling an animal opening and closing its mouth.

Referring to FIGS. 2 and 3, the cover 11 includes a pair of downwardly depending ears 32 on opposite sides supported on pivot pins 33 secured to the body adjacent the open upper end to provide a pivot axis for the head or cover 11.

The body 12 includes an upstanding peripheral side wall **12*a* and a bottom wall 12*b* spaced upwardly above the lower edges of the side wall to define a lower recess 12*c* between the bottom and a large toy storage chamber 12*d* above the bottom wall. At the front, the side wall 12*a* is formed with an opening 13 on the lower edge in communication with a channel 14 defined between a pair of integral, depending stepping ribs 15 on the underside of the bottom wall 12*b*. A pivot arm 23 is mounted in the channel on a pivot pin 24 supported from one or more of the ribs 15 and a foot pedal 20 shaped and decorated to resemble the foot of an animal is mounted on the outer forward end of the arm. At the rearward end, the arm is pivotally connected to the lower end of an upwardly extending lift rod 26 mounted in an integrally formed internal channel or recess 28 formed in the body 12 on the back side of the side wall 12*e* by a wall portion 12*d*. An upper end 26*a* of the lift rod 26 is rounded and extends upwardly of the open upper end of the chamber 28 to engage the underside of a top wall portion 11*a* of the cover or head 11 as shown in FIGS. 2 and 3. Downward movement of the foot pedal 20 results in clockwise opening movement of the head 11 on the body 12 and subsequent removal of downward pressure on the foot pedal results in the weight of the cover 11 and lift rod 28 moving downwardly until the cover is closed as shown in FIG. 2. When pressure on the foot pedal is released, the pedal returns upwardly until the inside surface engages the outer surface of the body side wall 12*a* and this stopping engagement limits further clockwise pivotal movement of the arm 23** so that the inner end does not touch the floor or other supporting surface.

Referring again now to FIG. 1, the storage apparatus 10 is designed and decorated to appear as an animal such as a lion and a young child is attracted and entertained by the appearance of the device and at the same time encouraged to store his toys therein by inserting them into the open mouth ringed by the rows of upper and lower teeth 16 and 18 respectively. When foot pedal pressure is released, the flexible teeth fold inwardly to the position as in FIG. 2 and the animal appears to have eaten the toys stored therein.

Although the present invention has been described with reference to a single illustrative embodiment thereof, it should be understood that numerous other modifications and embodiments can be devised by those skilled in the art that will fall within the spirit and scope of the principles of this invention.

What is claimed as new and desired to be secured by Letters Patent is:

1. A storage apparatus for storing toys and the like, comprising:

a hollow body having an open end for receiving toys, the outer side walls of said hollow body including indicating means thereon to resemble a generally torso portion of an animal's body;

a dome-shaped cover for said hollow body including a pointed portion at the front upper end thereof and a pair of downwardly projecting ears at the rearward end thereof, said cover including indicating means on the pointed portion to resemble a nose and indicating means on the flaps to resemble ears and additional indicating means over the domed surface to represent other facial features of an animal's head;

pivoting means on the downwardly projecting flaps of the cover pivotally mounting the cover on the body to open and close with respect to the upper end of said hollow body;

a plurality of downwardly projecting teeth around substantially the entire periphery of said cover opposite said flaps, said downwardly projecting teeth being formed of flexible material for deflecting inwardly when said cover is closed;

a plurality of upwardly projecting teeth around substantially the entire periphery of said open hollow body opposite said pivotal connection, said teeth being formed of flexible material for engaging the upper row of teeth when the cover is closed and deflecting inwardly as the teeth engage one another to provide a resilient seal between the body and cover;

a manually actuatable pedal supported for movement adjacent a lower portion of said body and projecting outwardly therefrom, said pedal including a bulbous type body and including indicating means representing paws and claws of an animal;

linkage means for interconnecting said foot pedal and said cover to pivotally open said cover away from the upper end of said body in response to downward pressure on said pedal, said linkage means including a pivot arm pivotally mounted adjacent a lower portion of said body and supporting said pedal on an outward portion thereof, and a vertically movable lift rod pivotally interconnected to said pivot arm at its lower end and having a generally rounded upper end for engaging the inner surface of the cover at a point forwardly of said pivot means to thereby open the cover and permit the cover to remain open when the pedal is depressed and subsequently released; and a recess defined in said hollow body including a plurality of internal wall means between the pedal and the cover for disguisingly mounting said linkage means.

2. The storage apparatus as in claim 1 wherein said bulbous body of the pedal is formed of flexible foam.

3. The storage apparatus of claim 1 or 2 wherein said flexible teeth are flexible foam.

* * * * *